US011655710B1

(12) United States Patent
Almorihil et al.

(10) Patent No.: US 11,655,710 B1
(45) Date of Patent: May 23, 2023

(54) SIDEWALL EXPERIMENTATION OF SUBTERRANEAN FORMATIONS

(71) Applicant: SAUDI ARABIAN OIL COMPANY, Dhahran (SA)

(72) Inventors: Jawaher Almorihil, Dhahran (SA); Abdulkareem AlSofi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/647,553

(22) Filed: Jan. 10, 2022

(51) Int. Cl.
*E21B 49/06* (2006.01)

(52) U.S. Cl.
CPC ..... *E21B 49/06* (2013.01)

(58) Field of Classification Search
CPC ..... E21B 49/06
See application file for complete search history.

(56) References Cited

U.S. PATENT DOCUMENTS

| | | | | |
|---|---|---|---|---|
| 7,500,388 | B2 | 3/2009 | Fujisawa et al. | |
| 7,789,170 | B2 | 9/2010 | Church | |
| 8,596,386 | B2 * | 12/2013 | Hopkins | E21B 43/10 175/77 |
| 9,359,891 | B2 | 6/2016 | Galvan-Sanchez et al. | |
| 9,507,047 | B1 | 11/2016 | Dvorkin et al. | |
| 9,650,891 | B2 | 5/2017 | Reid et al. | |
| 10,724,317 | B2 * | 7/2020 | Dusterhoft | E21B 25/10 |
| 2006/0000606 | A1 | 1/2006 | Fields et al. | |
| 2008/0066534 | A1 * | 3/2008 | Reid | E21B 49/06 73/152.13 |
| 2008/0066536 | A1 * | 3/2008 | Goodwin | E21B 49/10 73/152.24 |
| 2009/0159275 | A1 | 6/2009 | Kannan et al. | |
| 2009/0250207 | A1 | 10/2009 | May | |
| 2011/0174543 | A1 * | 7/2011 | Walkingshaw | E21B 49/06 175/58 |
| 2013/0081803 | A1 | 4/2013 | Tao et al. | |
| 2013/0199847 | A1 | 8/2013 | Delmar et al. | |
| 2014/0208826 | A1 | 7/2014 | Larter et al. | |

(Continued)

FOREIGN PATENT DOCUMENTS

WO 2005086699 A2 9/2005

OTHER PUBLICATIONS

Arora et al.; "Single-well In-situ Measurement of Residual Oil Saturation after an EOR Chemical Flood," SPE 129069; Society of Petroleum Engineers; Apr. 11, 2020; pp. 1-18 (18 pages).

(Continued)

*Primary Examiner* — Shane Bomar
(74) *Attorney, Agent, or Firm* — Osha Bergman Watanabe & Burton LLP

(57) ABSTRACT

A system for sidewall coring includes a sidewall coring tool lowered into a wellbore for positioning a coring bit inside a subterranean formation, an injection assembly, and an array of sensors. The coring bit is capable of collecting a core sample by rotating with respect to a housing of the sidewall coring tool. The injection assembly injects a plurality of fluids into a sidewall core and is configured to selectively inject a plurality of fluids into the core sample. The array of sensors is embedded within a sidewall cutter enclosure for recording measurements during an injection process. The array of sensors produces information relating to the core sample.

17 Claims, 2 Drawing Sheets

(56) References Cited

U.S. PATENT DOCUMENTS

| | | | | |
|---|---|---|---|---|
| 2014/0353479 | A1* | 12/2014 | Edwards | E21B 29/06 166/264 |
| 2018/0171788 | A1 | 6/2018 | Waid et al. | |
| 2018/0334905 | A1 | 11/2018 | Dahl et al. | |
| 2020/0045670 | A1 | 2/2020 | Gleitman et al. | |
| 2020/0379139 | A1 | 12/2020 | Hashem et al. | |
| 2021/0123344 | A1* | 4/2021 | Westacott | E21B 25/10 |
| 2021/0389294 | A1* | 12/2021 | Krueger | E21B 25/08 |

OTHER PUBLICATIONS

Cherukupalli et al.; "Analysis and Flow Modeling of Single Well MicroPilot* to Evaluate the Performance of Chemical EOR Agents", SPE 136767; Society of Petroleum Engineers; Nov. 1, 2020; pp. 1-16 (16 pages).

* cited by examiner

SIDEWALL EXPERIMENTATION OF SUBTERRANEAN FORMATIONS

BACKGROUND

A core is a cylindrical section of recovered drilled sediments of rocks. A core sample is a piece of sediment rock recovered from the drilled core. The core interval corresponds to a depth range in the drilled sediment of rocks. The cylindrical section resembles a column in shape and is also referred to as a rock core column. Core samples are usually obtained by drilling with a coring bit (e.g., hollow steel tube) into the sediment or rocks. Core samples are used for analysis of porosity, permeability, fluid saturation, among other compositional and textural rock properties. Sedimentology encompasses the study of modern sediments such as sand, silt, and clay, and the processes that result in their formation, transport, deposition, and diagenesis. Sedimentologists apply their understanding of modern processes to interpret geologic history through observations of sedimentary rocks and sedimentary structures.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments relate to a system for sidewall coring, the system comprising: a sidewall coring tool lowered into a wellbore for positioning a coring bit inside a subterranean formation, wherein the coring bit is capable of collecting a core sample by rotating with respect to a housing of the sidewall coring tool; an injection assembly for injecting a plurality of fluids into a sidewall core and configured to selectively inject a plurality of fluids into the core sample; and an array of sensors embedded within a sidewall cutter enclosure for recording measurements during an injection process, the array of sensors producing information relating to the core sample.

In one aspect, embodiments relate to a method for sidewall coring, the method comprising: lowering a sidewall assembly into a wellbore for positioning a coring bit inside a subterranean formation; activating a sidewall coring tool to position a coring bit inside a subterranean formation and collect a core sample by rotating the coring bit with respect to a housing of the sidewall coring tool; injecting a plurality of fluids into a sidewall core, configured to selectively inject a plurality of fluids into the core sample; and recording measurements during an injection process and producing information relating to the core sample.

Other aspects and advantages of the claimed subject matter will be apparent from the following description and the appended claims.

BRIEF DESCRIPTION OF DRAWINGS

Specific embodiments disclosed herein will now be described in detail with reference to the accompanying figures. Like elements in the various figures are denoted by like reference numerals for consistency. Like elements may not be labeled in all figures for the sake of simplicity.

DETAILED DESCRIPTION

Figure 1:
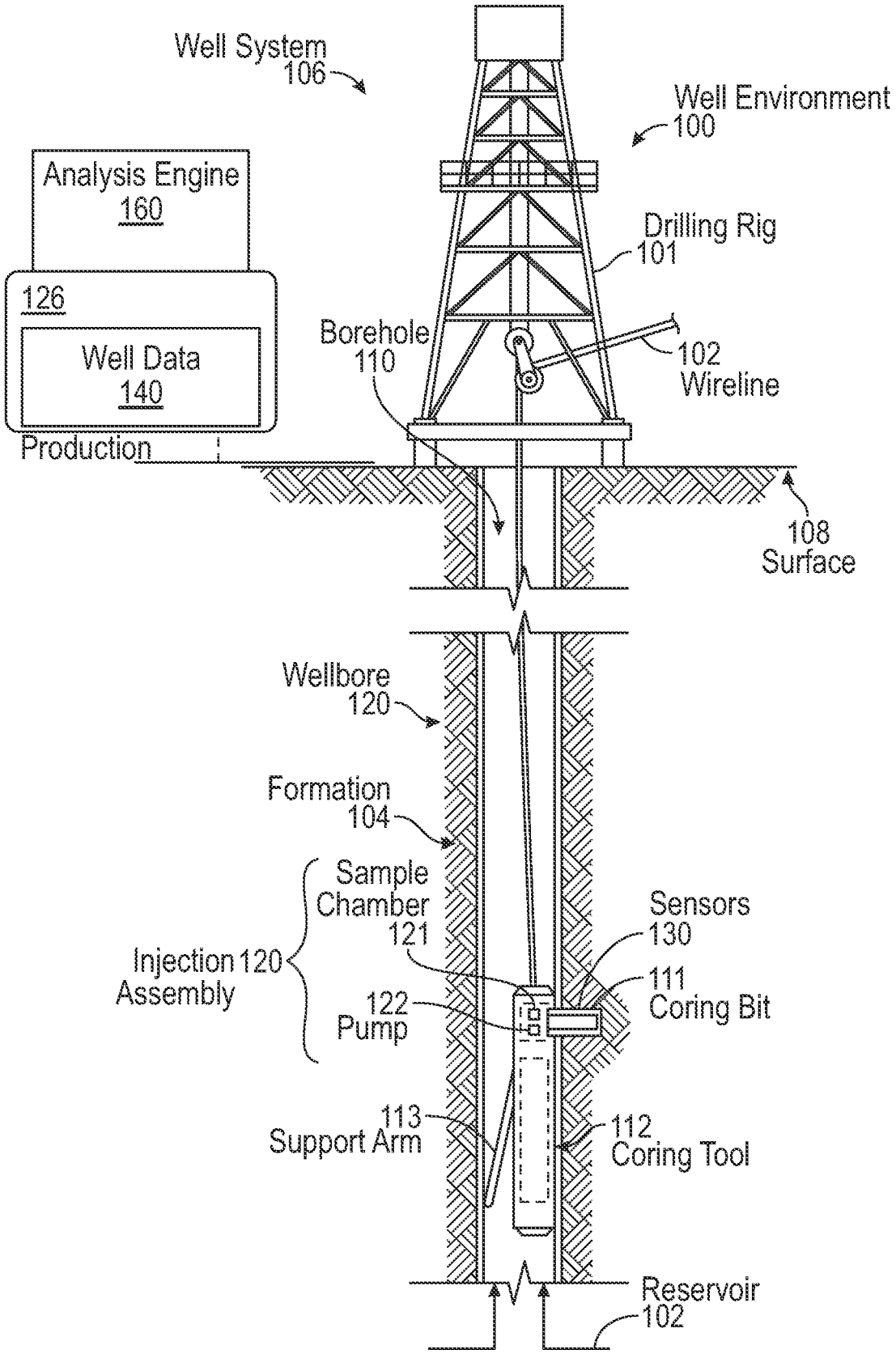
FIG. 1 shows a system in accordance with one or more embodiments.

In the following detailed description of embodiments disclosed herein, numerous specific details are set forth in order to provide a more thorough understanding disclosed herein. However, it will be apparent to one of ordinary skill in the art that the invention may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers does not imply or create a particular ordering of the elements or limit any element to being only a single element unless expressly disclosed, such as by the use of the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

In the following description of FIGS. 1-3, any component described with regard to a figure, in various embodiments disclosed herein, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

It is to be understood that the singular forms "a," "an," and "the" include plural referents unless the context clearly dictates otherwise. Thus, for example, reference to "a horizontal beam" includes reference to one or more of such beams.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It is to be understood that one or more of the steps shown in the flowcharts may be omitted, repeated, and/or performed in a different order than the order shown. Accordingly, the scope disclosed herein should not be considered limited to the specific arrangement of steps shown in the flowcharts.

Although multiple dependent claims are not introduced, it would be apparent to one of ordinary skill that the subject matter of the dependent claims of one or more embodiments may be combined with other dependent claims.

Embodiments disclosed herein provide a method and system for sidewall experimentation of subterranean formations. The disclosure builds on the art of wireline-conveyed side-wall coring operations. The disclosed tool repurposes conventional sidewall coring to perform in-situ flooding experiments and integrates new components such as chambers, a pump, and possibly sensors to allow the injection of one or more IOR and EOR agents. The in-situ side-wall experiments may be performed during or in-between logging operations such that the logging results will provide the assessment of IOR and EOR effects. Additionally, sensors can be integrated across the coring device to allow direct and pinpoint inference of effects including for example the changes in fluid saturations.

To begin with, FIG. 1 shows a schematic diagram in accordance with one or more embodiments. As shown in FIG. 1, a well environment (100) in which well log data quality control may be implemented, includes a hydrocarbon reservoir ("reservoir") (102) located in a subsurface hydrocarbon-bearing formation ("formation") (104) and a well system (106). The hydrocarbon-bearing formation (104) may include a porous or fractured rock formation that resides underground, beneath the earth's surface ("surface") (108). In the case of the well system (106) being a hydrocarbon well, the reservoir (102) may include a portion of the hydrocarbon-bearing formation (104). The hydrocarbon-bearing formation (104) and the reservoir (102) may include different layers of rock having varying characteristics, such as varying degrees of permeability, porosity, capillary pressure, and resistivity. In the case of the well system (106) being operated as a production well, the well system (106) may facilitate the extraction of hydrocarbons (or "production") from the reservoir (102).

The well system (106) includes a rig (101), a wellbore (120), and a well control system ("control system") (126). The well control system (126) may control various operations of the well system (106), such as well production operations, well drilling operation, well completion operations, well maintenance operations, and reservoir monitoring, assessment and development operations. In one or more embodiments, the well control system (126) includes a computer system that is the same as or similar to that of a computer system (300) described below in FIG. 3 and the accompanying description.

The rig (101) is the machine used to drill a borehole (110) to form the wellbore (120). Major components of the rig (101) include the drilling fluid tanks, the drilling fluid pumps (e.g., rig mixing pumps), the derrick or mast, the draw works, the rotary table or top drive, the drill string, the power generation equipment and auxiliary equipment.

The wellbore (120) includes a borehole (110) that extends from the surface (108) into a target zone of the hydrocarbon-bearing formation (104), such as the reservoir (102). An upper end of the wellbore (120), terminating at or near the surface (108), may be referred to as the "up-hole" end of the wellbore (120), and a lower end of the wellbore, terminating in the hydrocarbon-bearing formation (104), may be referred to as the "downhole" end of the wellbore (120). The wellbore (120) may facilitate the circulation of drilling fluids during drilling operations, the flow of hydrocarbon production ("production") (e.g., oil and gas) from the reservoir (102) to the surface (108) during production operations, the injection of substances (e.g., water) into the hydrocarbon-bearing formation (104) or the reservoir (102) during injection operations, or the communication of monitoring devices (e.g., logging tools) lowered into the hydrocarbon-bearing formation (104) or the reservoir (102) during monitoring operations (e.g., during in situ logging operations).

In one or more embodiments, during operation of the well system (106) a sidewall coring assembly may be suspended in the wellbore (120) using a wire that is supported by the rig (101). The sidewall coring tool (112) includes a coring tool (112) that drills into the wellbore (120) to obtain a sample of a side core. The coring tool additionally includes a coring bit, a support arm, and an injection assembly. The coring bit is designed to lay in direction perpendicular to the borehole and to rotate with respect to a housing of the coring tool. The coring bit includes a shaft with a hollow interior designed for the formation. The rotation of the shaft may be powered by a motor coupled to a shaft in order to cut the formation and obtain a core sample. Many different types of formation cutting elements for a rotary coring bit are known in the art and may be used without departing from the scope of this disclosure.

Further, in one or more embodiments, the coring bit may have coring and transport positions. While coring position is perpendicular to the wellbore, transport position is parallel to the wellbore and it stretches from the coring tool to the opening of the wellbore. During the coring process, the coring tool may apply a force and a torque to the coring bit, generated by the motor, to initiate the coring process. Subsequently, the resulting core specimen may be acquired by the core bit and disposed inside the core barrel. More specifically, the core barrel may include a special storage chamber within a coring tool for holding the core specimen. Furthermore, the core catcher may provide a grip to the bottom of a core and, as tension is applied to the drill string, the rock under the core breaks away from the undrilled formation below coring tool. Thus, the core catcher may retain the core specimen to avoid the core specimen falling through the bottom of the wellbore. The coring tool is braced in the wellbore by a support arm.

In one or more embodiments, the coring tool includes the injection assembly, consisted of a sample chamber and an injection pump. Specifically, the injection pump includes multiple injector valves connected to a number of different sample chambers with different sizes that are selectable based on injection profiles. The control system interfaces with the injection pump to control both the degree of the shutting and opening of the injector valves for the respective chambers, as well as the pressure at the injector valves. The injection pump is a metering pump that allows exact amount of fluid to be injected during the coring process. While the injection pump automatically adjusts the release valves based on the injection parameters from the control system, the injection pump also allows for manual adjustment of the release valves.

Further, in one or more embodiments, the sample chambers contain single or multiple fluids with different formulations and concentrations. The fluids may be improved oil recovery (IOR) agents and enhanced oil recovery (EOR) agents. IOR and EOR are methods used to target the resources not capable of being produced with conventional production methods.

The most common IOR methods are hydraulic fracturing and acidizing. Hydraulic fracturing includes injection of a fracturing fluid under the high pressure. The fracturing fluid may be water, gas, or gel, which are injected in a reservoir causing the rock to mechanically fail or fracture. Injection of the fracturing fluid is normally followed by the injection of a proppant slurry, composed of natural sand or man-made ceramic beads, used to prop-open the induced fractures once pressure is relieved after the well stimulation treatment.

Additionally, acidizing is a well technology that uses the injection of an acid solution into a porous reservoir to dissolve any residual coring fluids or natural sediments in the well perforations and the near-well vicinity. These residual coring fluids may impair fluid flow to the well. Several variations of the acidizing process are used to stimulate a well including a matrix acidizing and acid-fracturing. During the matrix acidizing the acid solution is pumped into the reservoir below the fracture pressure to clean pores near the well and during acid-fracturing an acidic fracturing fluid is injected above the fracture pressure in order to simultaneously fracture the reservoir and dissolve the formation. Specifically, the matrix acidizing is typically used in sandstone and carbonate reservoirs, while acid-fracturing is used in carbonate reservoirs which are susceptible to breakdown by acid.

EOR methods involve the injection of fluids into the reservoir, which aids in crude oil production by means other than simply supplying external reservoir energy. Known EOR agents include steam injection, gas injection (carbon dioxide, nitrogen, natural gas, etc.), steam flooding, chemical injection (acids, polymers, surfactants, micro emulsions, etc.), microbial injection, proppants in fracturing operations (sand, etc.), and reactants to determine the presence of particular constituents, such as hydrogen sulfide.

In one or more embodiments, the coring tool may include an array of sensors for analyzing the core sample. The sensors may be embedded at least, within or across the sidewall cutter enclosure. Specific sensors can be used based on the previously planned test by the control system and the application of associated fluids under evaluation. The sensors enable evaluating the core sample without the extraction of the core sample. Specifically, the sensors are monitoring the reactions between IOR and EOR agents and the core sample.

Specifically, the sensors may gather data on, at least, resistivity, porosity, permeability, etc. For example, resistivity can be measured to evaluate effects on fluid saturations which would be of special interest for applications related to oil displacement and recovery, porosity and permeability can be measured to evaluate near wellbore treatments such as fracturing and acid stimulation. Multiple chambers can be used to experiment different formulations, concentrations, or incremental effects of new processes against baseline practices.

In one or more embodiments, the well control system (126) collects and records well data (140) for the well system (106), supplied from the sensors. During coring operation of the well (106), the well data (140) may include formation characteristics. In one or more embodiments, the well data (140) are recorded in real-time, and are available for review or use within seconds, minutes or hours of the condition being sensed (e.g., the measurements are available within 1 hour of the condition being sensed). In such an embodiment, the well data (140) may be referred to as "real-time" well data (140). Real-time well data (140) may enable an operator of the well (106) to assess a relatively current state of the well system (106), and make real-time decisions regarding a development of the well system (106) and the reservoir (102).

In one or more embodiments, the well surface system (134) includes a wellhead (130). The wellhead (130) may include a rigid structure installed at the "up-hole" end of the wellbore (120), at or near where the wellbore (120) terminates at the Earth's surface (108). The wellhead (130) may include structures for supporting (or "hanging") casing and production tubing extending into the wellbore (120). In one or more embodiments, the well surface system (134) includes flow regulating devices that are operable to control the flow of substances into and out of the wellbore (120).

In one or more embodiments, the wellhead (130) includes a choke assembly. For example, the choke assembly may include hardware with functionality for opening and closing the fluid flow through pipes in the well system (106). Likewise, the choke assembly may include a pipe manifold that may lower the pressure of fluid traversing the wellhead. As such, the choke assembly may include a set of high pressure valves and at least two chokes. These chokes may be fixed or adjustable or a mix of both. Redundancy may be provided so that if one choke has to be taken out of service, the flow can be directed through another choke. In one or more embodiments, pressure valves and chokes are communicatively coupled to the well control system (126). Accordingly, a well control system (126) may obtain wellhead data regarding the choke assembly as well as transmit one or more commands to components within the choke assembly in order to adjust one or more choke assembly parameters.

Figure 2:
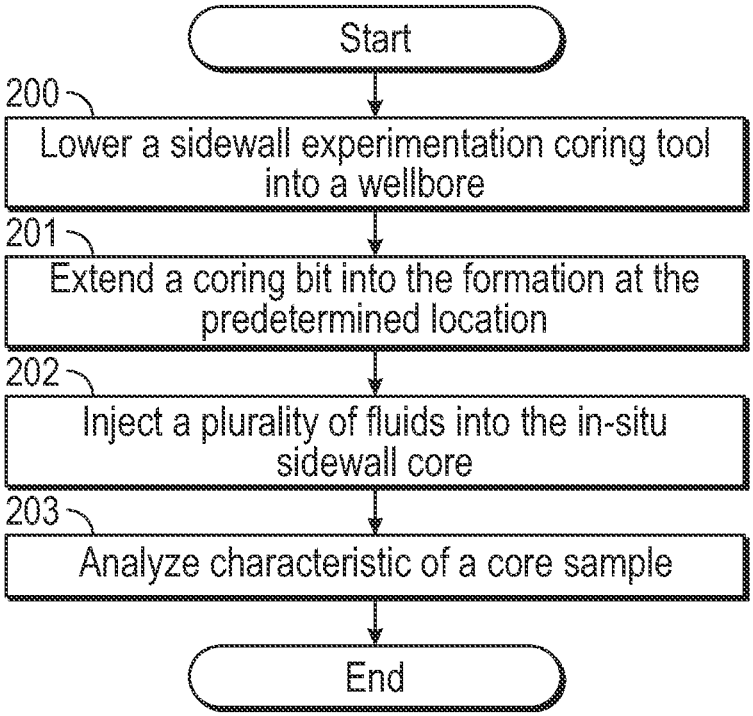
FIG. 2 shows a flowchart in accordance with one or more embodiments.
Figure 3:
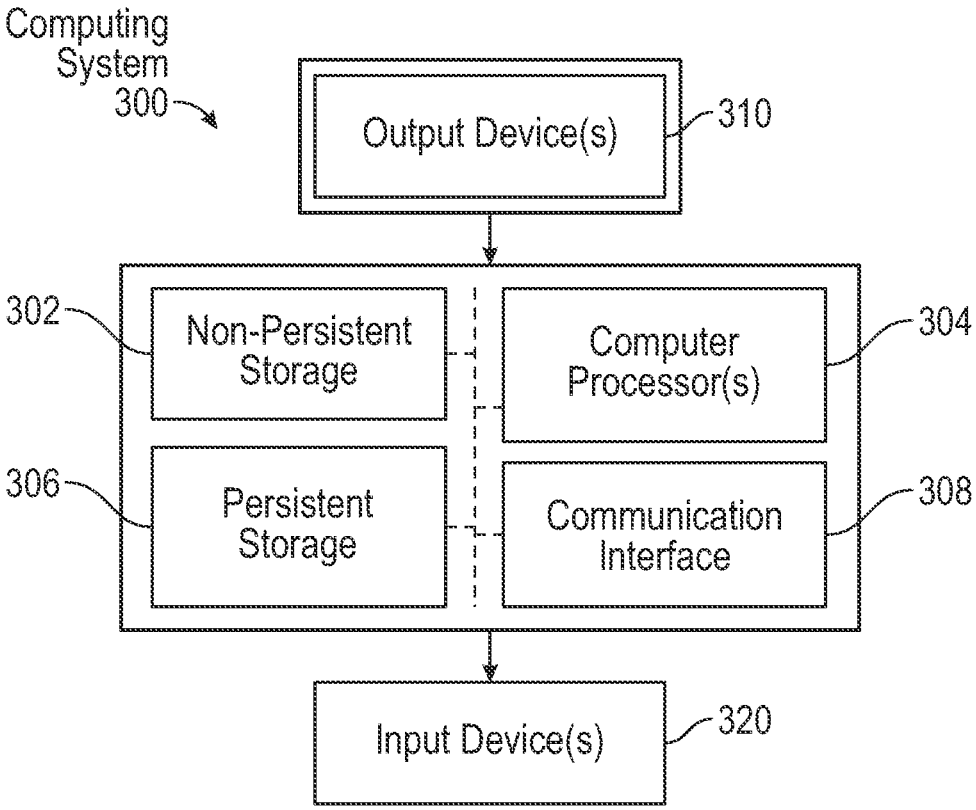
FIG. 3 shows a computer system in accordance with one or more embodiments.

Turning to FIG. 2, FIG. 2 shows a method flowchart in accordance with one or more embodiments. One or more blocks in FIG. 2 may be performed using one or more components as described in FIG. 1. While the various blocks in FIG. 2 are presented and described sequentially, one of ordinary skill in the art will appreciate that one or more or all of the blocks may be executed in different orders, may be combined or omitted, and one or more or all of the blocks may be executed in parallel and/or iteratively. Furthermore, the blocks may be performed actively or passively.

Initially in Block 400, the sidewall experimentation coring tool is lowered into a wellbore. The coring tool is lowered into a well using a wireline, supported by the rig, for electronic communication and power transmission. In general, the coring tool is lowered into a well so that it can measure formation properties at predetermined depths. The sidewall coring tool (112) additionally includes a coring tool (112) that drills into the wellbore (120) to obtain a sample of a side core. The coring tool needs to be precisely positioned at the location of coring and pressed to the sidewall. The position of the entire assembly is secured by the support arm, which is pressed against the wall and provides a stability to the coring tool.

In Block 201, the coring bit is extended into the formation at the predetermined location. The coring bit is extended into the formation at a direction perpendicular to the borehole. During the coring process the coring bit rotates with respect to a housing of the coring tool. The coring bit includes a shaft with a hollow interior designed to collect the sample of the formation. The rotation of the shaft may be powered by a motor coupled to a shaft in order to cut the formation and obtain a core sample.

In Block 202, a plurality of fluids is injected into the in-situ sidewall core. The injection is performed by the injection pump which includes multiple injector valves connected to a number of different sample chambers with different sizes that are selectable based on injection profiles. The control system interfaces with the injection pump to control both the degree of the shutting and opening of the injector valves for the respective chambers, as well as the pressure at the injector valves. The injection pump is a metering pump that allows exact amount of fluid to be injected during the coring process. While the injection pump automatically adjusts the release valves, based on the injection parameters from the control system, the injection pump also allows for manual adjustment of the release valves.

In one or more embodiments, the plurality of fluids is stored in the sample chambers. The sample chambers may contain single or multiple fluids with different formulations and concentrations. The fluids may be improved oil recovery (IOR) agents and enhanced oil recovery (EOR) agents. Applicable IOR methods may hydraulic fracturing and acidizing. Hydraulic fracturing includes injection of a fracturing fluid under the high pressure. The fracturing fluid may be water, gas, or gel, which are injected in a reservoir causing the rock to mechanically fail or fracture. Additionally, acidizing is a well technology that uses the injection of an acid solution into a porous reservoir to dissolve any residual coring fluids or natural sediments in the well perforations and the near-well vicinity.

EOR methods involve the injection of fluids into the reservoir, which aids in crude oil production by means other than simply supplying external reservoir energy. Known EOR agents include steam injection, gas injection (carbon dioxide, nitrogen, natural gas, etc.), steam flooding, chemical injection (acids, polymers, surfactants, micro emulsions, etc.), microbial injection, proppants in fracturing operations (sand, etc.), and reactants to determine the presence of particular constituents, such as hydrogen sulfide.

In Block 203, the sensors are monitoring the coring process and they are gathering data about the core sample. The sensors are positioned along the coring bit and they may analyze the sample core before and after injecting the fluids. The sensors are gathering data about the predefined characteristics of the core sample, without requiring the extraction of the core sample to the surface. Additionally, the sensors may monitor the reactions between IOR and EOR agents and the core sample.

Specifically, the sensors may gather data on, at least, resistivity, porosity, permeability, etc. For example, resistivity can be measured to evaluate effects on fluid saturations which would be of special interest for applications related to oil displacement and recovery, porosity and permeability can be measured to evaluate near wellbore treatments such as fracturing and acid stimulation. Multiple chambers can be used to experiment different formulations, concentrations, or incremental effects of new processes against baseline practices.

In one or more embodiments, the well control system (126) collects and records well data (140) for the well system (106), supplied from the sensors. During coring operation of the well (106), the well data (140) may include formation characteristics. In one or more embodiments, the well data (140) are recorded in real-time, and are available for review or use within seconds, minutes or hours of the condition being sensed (e.g., the measurements are available within 1 hour of the condition being sensed). In such an embodiment, the well data (140) may be referred to as "real-time" well data (140). Real-time well data (140) may enable an operator of the well (106) to assess a relatively current state of the well system (106), and make real-time decisions regarding a development of the well system (106) and the reservoir (102).

Embodiments may be implemented on a computing system. Any combination of mobile, desktop, server, router, switch, embedded device, or other types of hardware may be used. For example, as shown in FIG. 3, the computing system (300) may include one or more computer processors (304), non-persistent storage (302) (e.g., volatile memory, such as random access memory (RAM), cache memory), persistent storage (306) (e.g., a hard disk, an optical drive such as a compact disk (CD) drive or digital versatile disk (DVD) drive, a flash memory, etc.), a communication interface (308) (e.g., Bluetooth interface, infrared interface, network interface, optical interface, etc.), and numerous other elements and functionalities.

The computer processor(s) (304) may be an integrated circuit for processing instructions. For example, the computer processor(s) may be one or more cores or micro-cores of a processor. The computing system (300) may also include one or more input devices (320), such as a touchscreen, keyboard, mouse, microphone, touchpad, electronic pen, or any other type of input device.

The communication interface (308) may include an integrated circuit for connecting the computing system (300) to a network (not shown) (e.g., a local area network (LAN), a wide area network (WAN) such as the Internet, mobile network, or any other type of network) and/or to another device, such as another computing device.

Further, the computing system (300) may include one or more output devices (310), such as a screen (e.g., a liquid crystal display (LCD), a plasma display, touchscreen, cathode ray tube (CRT) monitor, projector, or other display device), a printer, external storage, or any other output device. One or more of the output devices may be the same or different from the input device(s). The input and output device(s) may be locally or remotely connected to the computer processor(s) (304), non-persistent storage (302), and persistent storage (306). Many different types of computing systems exist, and the aforementioned input and output device(s) may take other forms.

Software instructions in the form of computer readable program code to perform embodiments of the disclosure may be stored, in whole or in part, temporarily or permanently, on a non-transitory computer readable medium such as a CD, DVD, storage device, a diskette, a tape, flash memory, physical memory, or any other computer readable storage medium. Specifically, the software instructions may correspond to computer readable program code that, when executed by a processor(s), is configured to perform one or more embodiments of the disclosure.

While the disclosure has been described with respect to a limited number of embodiments, those skilled in the art, having benefit of this disclosure, will appreciate that other embodiments may be devised which do not depart from the scope of the disclosure as disclosed herein. Accordingly, the scope of the disclosure should be limited only by the attached claims.

Although the preceding description has been described herein with reference to particular means, materials and embodiments, it is not intended to be limited to the particulars disclosed herein; rather, it extends to all functionally equivalent structures, methods and uses, such as are within the scope of the appended claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A system for sidewall coring, the system comprising:

a sidewall coring tool lowered into a wellbore for positioning a coring bit inside a subterranean formation, wherein the coring bit is capable of collecting a core sample by rotating with respect to a housing of the sidewall coring tool;

an injection assembly for injecting a plurality of fluids into a sidewall core and configured to selectively inject the plurality of fluids into the core sample; and an array of sensors embedded within a sidewall cutter enclosure for recording measurements during an injection process, the array of sensors producing information relating to the core sample, wherein the injection assembly further comprises:

a plurality of sample chambers for storing the plurality of fluids; and an injection pump, connected to the plurality of sample chambers, for injecting the plurality of fluids, wherein the injection pump comprises a plurality of release controls that are configured to release, in response to control signals, the plurality of fluids from the plurality of sample chambers, and wherein the coring bit has an outlet for the plurality of fluids injected into the core sample for avoiding a pressure buildup.

2. The system of claim 1, wherein the sidewall coring tool further comprises a support arm to stabilize the sidewall coring tool inside the wellbore.

3. The system of claim 1, wherein the plurality of sample chambers contains the plurality of fluids with different formulations and concentrations.

4. The system of claim 1, wherein the plurality of fluids are improved oil recovery agents.

5. The system of claim 1, wherein the plurality of fluids are enhanced oil recovery agents.

6. The system of claim 1, wherein the injection pump injects the plurality of fluids across a formation face and into a sidewall enclosure.

7. The system of claim 1, wherein the injection pump injects the plurality of fluids from valves placed across a sidewall enclosure.

8. The system of claim 1, wherein the array of sensors is embedded across the sidewall cutter enclosure.

9. The system of claim 1, wherein the array of sensors is used based on planned tests and an application of associated fluids under evaluation.

10. The system of claim 1, wherein the array of sensors evaluates effects on fluid saturations based on a plurality of measurements.

11. A method for sidewall coring, the method comprising:

lowering a sidewall assembly into a wellbore for positioning a coring bit inside a subterranean formation;

activating a sidewall coring tool to position the coring bit inside the subterranean formation and collect a core sample by rotating the coring bit with respect to a housing of the sidewall coring tool;

injecting a plurality of fluids into a sidewall core, configured to selectively inject the plurality of fluids into the core sample; and recording measurements during an injection process and producing information relating to the core sample, wherein the coring bit has an outlet for the plurality of fluids injected for avoiding pressure buildup.

12. The method of claim 11, wherein a plurality of sample chambers contains the plurality of fluids with different formulations and concentrations.

13. The method of claim 11, wherein an injection pump injects the plurality of fluids across a formation face and into a sidewall enclosure.

14. The method of claim 11, wherein an injection pump injects the plurality of fluids from valves placed across a sidewall enclosure.

15. The method of claim 11, wherein an array of sensors is embedded across the coring bit.

16. The method of claim 11, wherein an array of sensors is used based on planned tests and an application of associated fluids under evaluation.

17. The method of claim 11, wherein an array of sensors evaluates effects on fluid saturations based on a plurality of measurements.

* * * * *